United States Patent [19]

Oglesby et al.

[11] 4,281,809

[45] Aug. 4, 1981

[54] METHOD OF PRECISION BOMBING

[75] Inventors: Frank P. Oglesby, Indianapolis; Walter L. Wuster, Greenwood, both of Ind.

[73] Assignee: The United States of America as represented by the Secretary of the Navy, Washington, D.C.

[21] Appl. No.: 102,721

[22] Filed: Dec. 13, 1979

[51] Int. Cl.[3] ..... F41G 7/00

[52] U.S. Cl. ..... 244/3.16; 244/3.14

[58] Field of Search ..... 244/3.15, 3.16, 3.19, 244/3.13, 3.14; 102/19.2, 214; 344/112 R

[56] References Cited

U.S. PATENT DOCUMENTS

| | | | |
|---|---|---|---|
| 3,054,099 | 9/1962 | Gaertner et al. | 343/6.5 |
| 3,226,718 | 12/1965 | Earp | 343/106 |
| 3,241,137 | 3/1966 | Smoll | 343/6.8 |
| 3,306,556 | 2/1967 | Kaufman | 244/3.17 |
| 3,698,816 | 10/1972 | Lutchansky | 356/152 |
| 3,735,944 | 5/1973 | Bannett et al. | 244/3.15 |
| 3,780,967 | 12/1973 | Evers et al. | 244/3.16 |
| 3,845,486 | 10/1974 | Birchenough | 343/106 |
| 3,875,862 | 4/1975 | Fischer et al. | 102/19.2 |
| 3,922,968 | 12/1975 | Conger et al. | 102/214 |
| 3,949,954 | 4/1976 | Lipsey | 244/3.15 |

*Primary Examiner*—Sal Cangialosi

[57] ABSTRACT

A method of bombing a plurality of targets is provided by launching a precision-guided weapon toward a prime target and having the weapon disperse a plurality of homing beacons prior to impact with the prime target. Then one or more relatively inexpensive weapons are launched and are guided to secondary targets by homing on the beacons previously dispersed.

7 Claims, 2 Drawing Figures

METHOD OF PRECISION BOMBING

BACKGROUND OF THE INVENTION

The present invention relates to a method of air-to-surface bombing and more particularly to a method of bombing which will provide maximum effectiveness at a minimum of cost.

During the past decade, very sophisticated weapons have been designed to provide precision air-to-surface bombing. For example, one such weapon being used by the Navy is designated "WALLEYE", which is an air-to-surface electro-optical guided glide bomb. Prior to launch, the target area viewed by the WALLEYE guidance section television camera is displayed on a TV monitor in the aircraft carrying the WALLEYE. The pilot positions the camera to center the target in a gate displayed on the TV monitor, locks the camera on the target, and releases the weapon. After weapon release, the target area is no longer displayed on the TV monitor in the aircraft, and the pilot is free to depart. During weapon flight, the guidance section provides signals to the control section which in turn maneuvers the fins to keep the weapon on target.

In an improved version of WALLEYE, an extended range data link system is added which provides a means of retargeting the WALLEYE guided glide weapon after launch to extend delivery range. The pilot accomplishes WALLEYE weapon retargeting by means of manual inputs to the control group which, in turn, provides the pod with electrical signals from voltage controlled oscillators. The pod transmits the controller commands to the weapon, which then transmits a picture of the weapon's camera field of view to the pod for display on the pilot's video monitor. The pilot can activate or deactivate the data link at will until weapon launch. After launch, the weapon continues video transmission to provide a continuous TV display on the pilot's video monitor.

Another air-to-surface missile being used operates similar to the WALLEYE missile except that an infrared imaging device is used in the missile guidance unit, rather than a TV camera. An infrared imaging device is particularly suited for night operation and during inclement weather.

The so-called "smart bombs", such a WALLEYE, are capable of precision bombing and, in addition, do not require the pilot of a launch vehicle to wait around in the vicinity of the enemy while guiding the projectile toward the target. The disadvantage of such "smart bombs" is that the precision guidance section adds greatly to the cost of the weapon and is a "one-time" expendable item.

SUMMARY OF THE INVENTION

The present inventon provides a method of increasing damages to an enemy's resources but minimizes costs by using one precision-guided weapon and one or more less expensive weapons. A precision-guided weapon is launched at a prime target but before destruction one or more beacons are dispersed which are then used to direct one or more less-expensive weapons to vicinity targets.

It is therefore a general object of the present invention to provide for maximum destruction of an enemy area at a minimum of cost while allowing a pilot of a launch vehicle to return to home base before the projectiles reach their target.

Other objects, advantages and novel features of the present invention will become apparent from the following detailed description of the invention when considered in conjunction with the accompanying drawing.

DESCRIPTION OF A PREFERRED EMBODIMENT

In addition to the "smart bombs", which contain a high cost navigation system, there now exists various weapon seekers which are relatively low in cost but are not capable of stand-alone precision operation. One example of a relatively low cost weapon is the well-known laser guided bomb which requires that the target be illuminated, which requirement could endanger the vehicle or person assigned the illumination task. Another relatively low-cost seeker is the non-imaging infrared seeker which can be applied against surface targets immersed in some form of IR clutter. This non-imaging IR seeker has a severe problem of boresighting and of target discrimination. A third type of low-cost seeker is the Anti-Radar Missile (ARM) operating in a home-on-jam mode. The disadvantage of this ARM seeker is that the target must be an active RF emitter and is useful in a simple mode of operation only when RF emissions are uninterrupted.

One type of seeker is described in U.S. Pat. No. 3,306,556, entitled, "Automatic Guidance System", which issued Feb. 28, 1967, to Richard F. Kaufman. This guidance system employs a light-differentiating device such as a vidicon tube which is mounted in the nose of a proposed missile. The electron beam within the tube is aligned so as to coincide with the axis of the missile. This electron beam strikes an image plate on the face of the tube and thus establishes the target light intensities immediately as the missile is fired toward the target. When the missile gets off target course during its flight the beam is able to distinguish a change of light intensity on the image plate in the area immediately surrounding the target. This change of light intensity originates a spiral search sweep by the beam in an effort to again establish the original target intensity. As the beam sees the target at its original intensity, it looks at this point, providing a reference position from target to missile. This reference position information is fed to the control section to provide course guidance.

Figure 1:
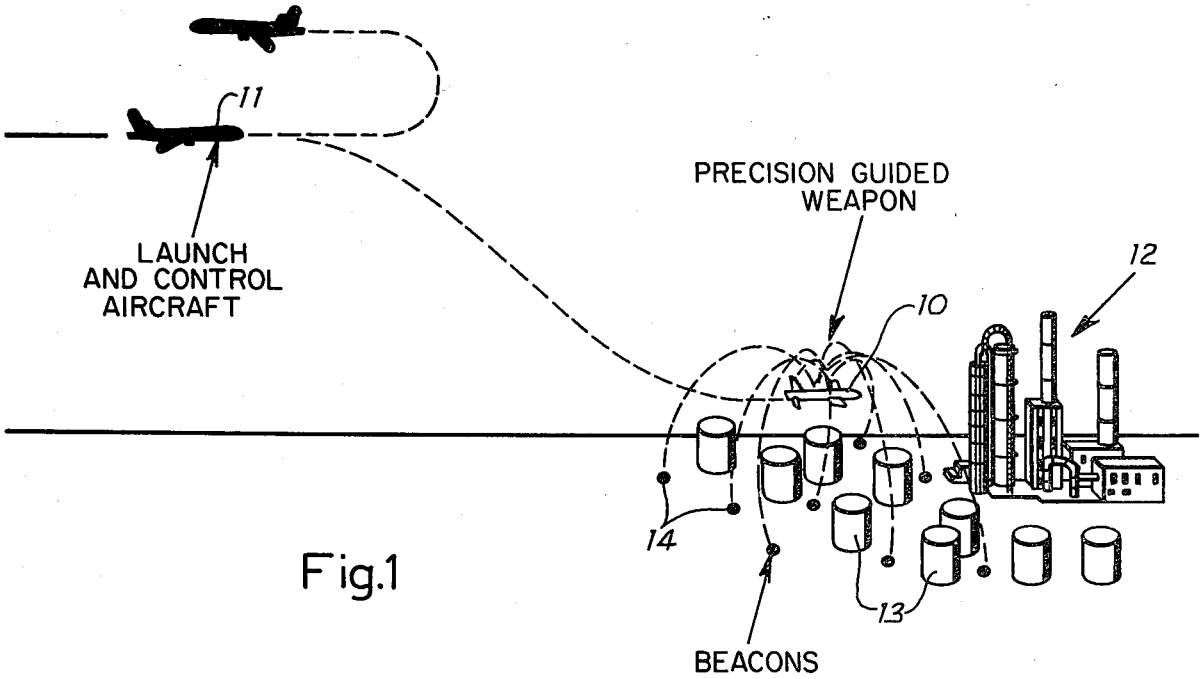
FIG. 1 is a sketch showing a precision guided weapon launching a plurality of beacons prior to the weapon hitting a primary target.

Referring now to the drawing, there is shown a technique for aiding low-cost seekers of the above-described types. In a land environment, there is frequently a high priority target and a number of lower priority targets which may be geographically dispersed over an area which is large compared to the normal effective destructive area of a weapon. One such example might be an oil refinery which is surrounded by storage tanks. FIG. 1 of the drawing depicts a precision guided weapon 10 being launched from an aircraft 11 and directed against an oil refinery 12 which has a plurality of storage tanks 13 adjacent or near refinery 12. By way of example, guided weapon 10 might have an imaging infrared guidance unit and the weapon might be directed against a critical thermally hot area of the target. In addition, the seeker could be equipped with a data link and the weapon launched at a stand-off range at or beyond the range of existing local ground defenses. Prior reconnaissance could be used to help choose a flight path so that the planned course of weapon 10 would be over an area in which the storage tanks 13 are located. When weapon 10 passes over tanks 13, small packages containing one or more types of beacons 14 could be dispersed from weapon 10 so that they would land near tanks 13. By way of example, beacons 14 might be automatically separated from weapon 10, such as by an ejector which senses altitude, or beacons 14 might be separated upon command from aircraft 11. Weapon 10 would continue on-course toward refinery 12. Beacons 14 would then be activated, either by command or automatically, to radiate a signal having a characteristic signature so that a relatively low-cost seeker could home on the radiated signal.

The signals radiating from beacons 14 might have a wavelength and pulse characteristic suitable for a laser seeker or might be coded IR signals within the wavelength region of a non-imaging IR seeker. Still another type of signal might be an RF signal with pulses suitable for a low-cost "home-on-jam" seeker.

Figure 2:
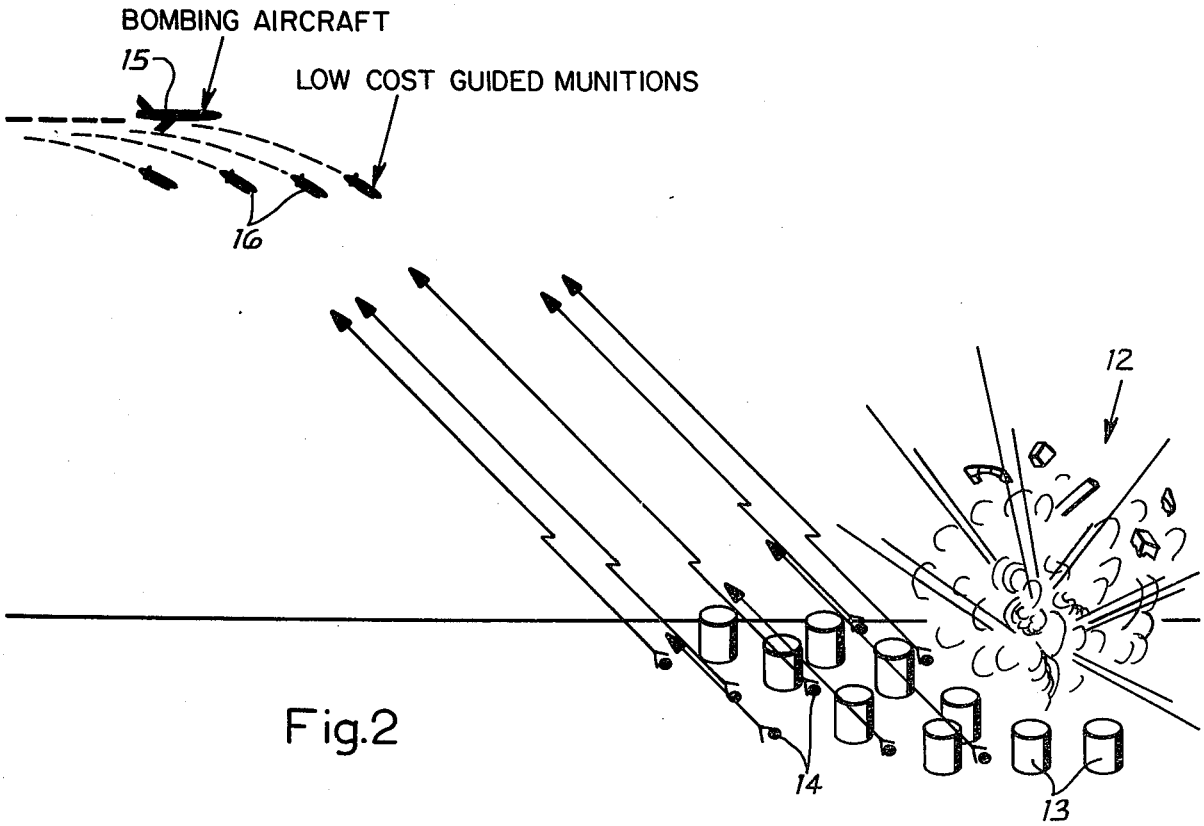
FIG. 2 is a sketch showing a plurality of low cost weapons homing on the previously dispersed beacons.

Referring now to FIG. 2 of the drawing, there is depicted a scene similar to that shown in FIG. 1, except at a later time after weapon 10 has struck refinery 12 and beacons 14 are in a transmitting stage. A bombing aircraft 15, which might be either the same aircraft that launched weapon 10 or a different aircraft, is shown launching a plurality of low-cost missiles 16 which have a homing device which homes on the signals being transmitted by beacons 14. Both beacons 14 and the seeker in each missile 16 might be of the type well-known in the art. By way of example, one type of beacon is described in U.S. Pat. No. 3,054,099, entitled, "Beacon Distress Signal" which issued Sept. 11, 1962, to Erwin R. Gaerttner and Roy G. Heaton. This patent describes a coding circuit which will produce a special, easily recognizable signal for use as a distress signal.

One type of homing missile is shown and described in U.S. Pat. No. 3,780,967, entitled, "Homing Missile", which issued Dec. 25, 1973, to Ernst T. Evers and Robert L. Morgan. This patent describes a missile having a plurality of quasi-optical horn shaped baffles which are arranged on the nose of the missile. Each of the horns covers a portion of a hemisphere forward of the body of the missile. "Quasi-optical" intended to denote those frequencies in or below the visible portion of the electromagnetic spectrum. These frequencies are amendable to treatment by optical techniques, and include visible light, infrared, and very short wavelength microwave. A point-source or equivalent target appearing in the above-mentioned hemisphere will cause an output from one (and only one) of the said horns. This output is applied to a means for converting the output into a control signal for guiding the missile. The means for converting could be a digital-to-analog converter, wherein the inputs to the converter are from the individual horns. Depending on which horn is providing an output, the converter will provide a corresponding analog output, which analog output may be used to guide the missile. A separate plurality of horns would be necessary for control of pitch and yaw of the missile. The missile must be stabilized from rolling, in order to decouple pitch and yaw controls.

Some of the advantages of the present invention should now be readily apparent. The method of the present invention directs a more expensive weapon at a first priority target and is also utilized in assisting less expensive weapons to inflict damage to secondary targets which are near the first priority target. By using propelled missiles which have an automatic guidance system, a pilot of a launching aircraft can avoid an area near a target where the launching aircraft might be subjected to continual ground fire.

Obviously many modifications and variations of the present invention are possible in the light of the above teachings. It is therefore to be understood that the invention may be practiced otherwise than as specifically described.

We claim:

1. A method of attacking a plurality of targets comprising, first launching at a primary target a precision guided explosive weapon carrying at least one signal beacon, then separating said at least one signal beacon to land in a position near said primary target, then detonating said explosive weapon, and then launching at least one weapon having a guidance system which will home on said at least one signal beacon.

2. A method of attacking a plurality of targets as set forth in claim 1 wherein said precision guided weapon has a guidance system comprised of a camera tube having a signal output proportional to the light intensity viewed by said camera tube.

3. A method of attacking a plurality of targets as set forth in claim 1 wherein said precision guided weapon has a guidance system comprised of an infrared seeker.

4. A method of attacking a plurality of targets as set forth in claim 1 wherein said at least one signal beacon emits a radio frequency signal.

5. A method of attacking a plurality of targets as set forth in claim 1 wherein said at least one signal beacon emits light.

6. A method of attacking a plurality of targets as set forth in claim 1 wherein said at least one signal beacon is automatically separated from said precision guided weapon.

7. A method of attacking a plurality of targets as set forth in claim 1 wherein said at least one signal beacon is separated from said precision guided weapon upon command from a launch vehicle.

* * * * *